US005647442A

United States Patent [19]

Lange

[11] Patent Number: 5,647,442

[45] Date of Patent: Jul. 15, 1997

[54] DRILL RIG WITH CARRIER/MAST SAFETY INTERLOCK

[76] Inventor: James E. Lange, P.O. Box 1670, LaPorte, Ind. 46350

[21] Appl. No.: 503,711

[22] Filed: Jul. 18, 1995

[51] Int. Cl.[6] ..... E21C 11/02

[52] U.S. Cl. ..... 173/28; 173/27; 173/184

[58] Field of Search ..... 173/27, 28, 184, 173/185, 42, 193

[56] References Cited

U.S. PATENT DOCUMENTS

| | | | |
|---|---|---|---|
| 3,734,211 | 5/1973 | Haisch et al. | 173/28 |
| 3,771,547 | 11/1973 | Coleman | 173/202 |
| 4,303,130 | 12/1981 | Bonca | 173/27 |
| 4,363,519 | 12/1982 | Howard | 173/27 |
| 4,442,904 | 4/1984 | Wibom | 173/28 |
| 5,085,280 | 2/1992 | Rassieur | 173/176 |
| 5,540,292 | 7/1996 | Behrens | 173/184 |
| 5,570,975 | 11/1996 | Reinert, Sr. | 173/184 |

*Primary Examiner*—Scott A. Smith
*Attorney, Agent, or Firm*—Baker & Daniels

[57] ABSTRACT

A drill rig includes a carrier such as a flatbed truck and a drilling unit carried by the carrier. The drilling unit includes a support frame, a mast and feed frame pivotally mounted on the support frame and movable between a lowered position for road travel and an operative position, and a safety interlock for disabling the engine of the carrier after the mast and/or feed frame have been moved to the operative position until the mast and/or feed frame returned to the fully lowered position.

19 Claims, 5 Drawing Sheets

DRILL RIG WITH CARRIER/MAST SAFETY INTERLOCK

BACKGROUND OF THE INVENTION

This invention relates to a drill rig for earth boring that is equipped with a safety interlock for disabling the carrier of the drill rig once the feed frame and mast has been erected until the feed frame and mast are lowered.

Drill rigs are often required to make multiple earth borings in a given area. Drill rigs are equipped with a mast and a feed frame, which are raised to effect drilling operation and lowered when the drill rig is moved. The feed frame may be disconnected from the mast so that the feed frame may be raised and lowered while the mast remains in the lowered position. The operator of the drill rig is tempted to move the drill rig with the mast and feed frame, or feed frame alone, raised when a number of borings must be made in a relatively small area. By failing to lower the mast and/or feed frame, the drill rig operator saves time, but moving the carrier with the mast and/or feed frame erected is exceedingly dangerous. Most accidents occur when moving the drill rig with the mast and/or feed frame erected; for example, the mast may strike overhead power lines, seriously injuring or even causing death to the drill rig operator and also disrupting the power lines. Accordingly, it is desirable to assure that the carrier of the drill rig cannot move the drill rig with the mast and/or feed frame erected. However, there are occasions when it is desirable to be able to move the carrier as the mast is being raised. For example, borings are sometimes taken within closed structures, and it is desirable to be able to move the drill rig short distances to manipulate the mast as it is being erected around the building structural components. It is also desirable that the safety interlock preventing operation of the carrier while the mast is erected not be easily defeated.

SUMMARY OF THE INVENTION

The present invention provides a drill rig in which switches sense the mast in a lowered position, the erected position, and an intermediate position between the lowered and erected position. The switches control a relay that permits operation of the carrier as the mast is being erected, but, once the mast is in the fully erected position, prevents operation of the carrier until the mast is again lowered to the fully lowered position. Accordingly, the carrier may be used to manipulate the mast around obstacles as it is being raised, but the carrier cannot be moved once the mast is in the fully erected position. Furthermore, since the switches must be actuated sequentially, it is difficult to defeat the safety interlock by holding one or more switches closed. According to another embodiment of the invention, a drill rig equipped for angled drilling in which the feed frame and/or mast are raised only to an angled position is equipped with switches that require the mast and/or feed frame to be moved to the lowered position after being raised to a predetermined angle before the carrier can be moved.

BRIEF DESCRIPTION OF THE DRAWINGS

These and other advantages of the present invention will become apparent from the following description, with reference to accompanying drawings, in which.

DESCRIPTION OF THE PREFERRED EMBODIMENT

Figure 1:
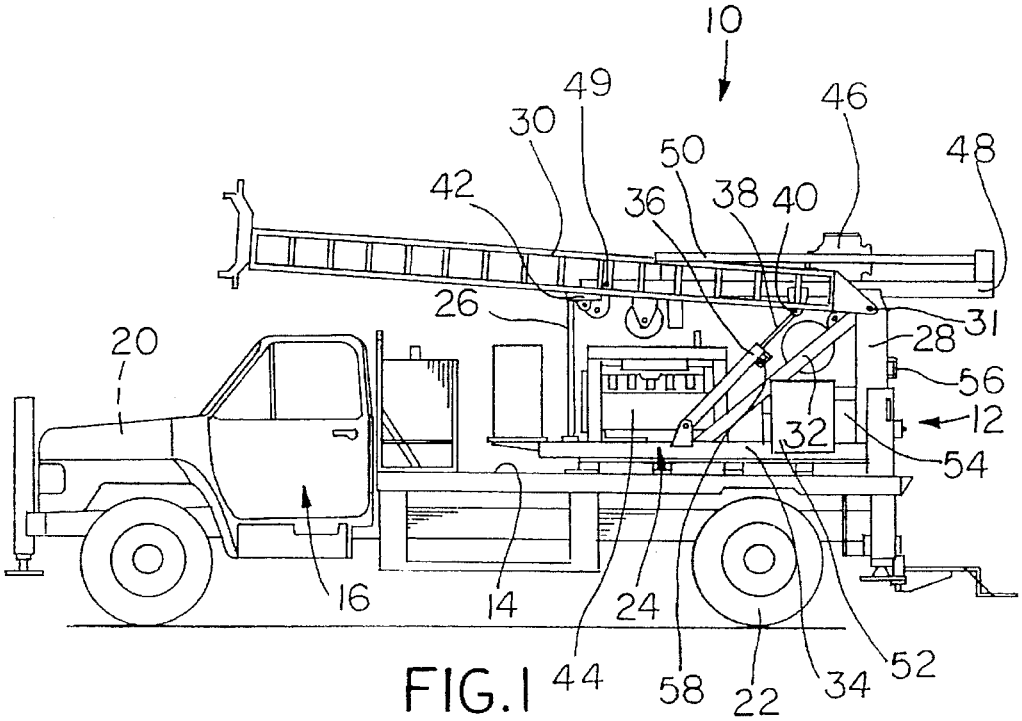
FIG. 1 is a side elevational view of a drill rig made according to the teachings of the present invention illustrated with the mast in the fully lowered position.

Referring now to the drawings, a drill rig generally indicated by the numeral 10 includes a drilling unit 12 which is mounted on the bed 14 of a flatbed truck generally indicated by the numeral 16. The flatbed truck 16 is conventional, and is powered by an engine 18 located within conventional engine compartment 20. The engine 18 drives rear wheels 22 of the truck 16. Although the drilling unit 12 is illustrated as being mounted on a flatbed truck, the drilling unit 12 may also be mounted on other types of carriers, such as an all-terrain vehicle.

The drilling unit 12 includes a support frame 24 mounted on the bed 14. Support frame 24 includes vertical members 26, 28. A mast 30 and feed frame 48 are pivotally attached to the vertical member 28 by pivots 31. An angled brace 32 extends between bottom portion 34 of support frame 24 and vertical support member 28. A pair of hydraulic cylinders 36 on opposites side of support frame 24 extend between the bottom portion 34 and the feed frame 48 for raising and lowering the latter. Piston rods 38 extends from the hydraulic cylinders 36 and are attached to the feed frame 48 at pivot connections 40 so that upon extension of the rods 38 out of the cylinders 36 the feed frame 48 pivots about the pivots 31 to thereby raise the feed frame 48 and mast 30 which is connected to feed frame 48 by pivot pin 49, from the lowered position illustrated in FIG. 1 to the erected position illustrated in FIG. 3.

The drilling unit 12 is powered by an engine 44 separate from the engine 18 which powers the carrier or truck 16. Drilling is effected by attaching a tool to a rotary gearbox 46 which is mounted for movement along the feed frame 48 which is pivotally mounted on support 28 by the pivots 31 which also pivotally connect the mast 30 to the support. The pin 49 connecting feed frame 48 with mast 30 is removable to permit the feed frame 48 to be raised and lowered while the mast remains in the lowered position. The feed frame 48 includes hydraulic actuators 50 for moving the rotary gearbox 46 along the feed frame 48. Power is transmitted from engine 44 to the gearbox 46 when the mast 30 is in the erected position illustrated in FIG. 3 through a conventional transmission 52 and right angle drive 54. A kelley bar (not shown) extends from the right angle drive 54 and engages a sliding connection with the gearbox 46, to thereby complete the power drive train between the engine 44 and the rotary gearbox 46. The mast 30 and the feed frame 48 are supported on a gusset 42 on support member 26 when in the lowered positions. The invention is also applicable to drilling rigs that are equipped with a hydraulic drive head instead of a rotary gearbox, kelley bar, and right angle drive.

Figure 3:
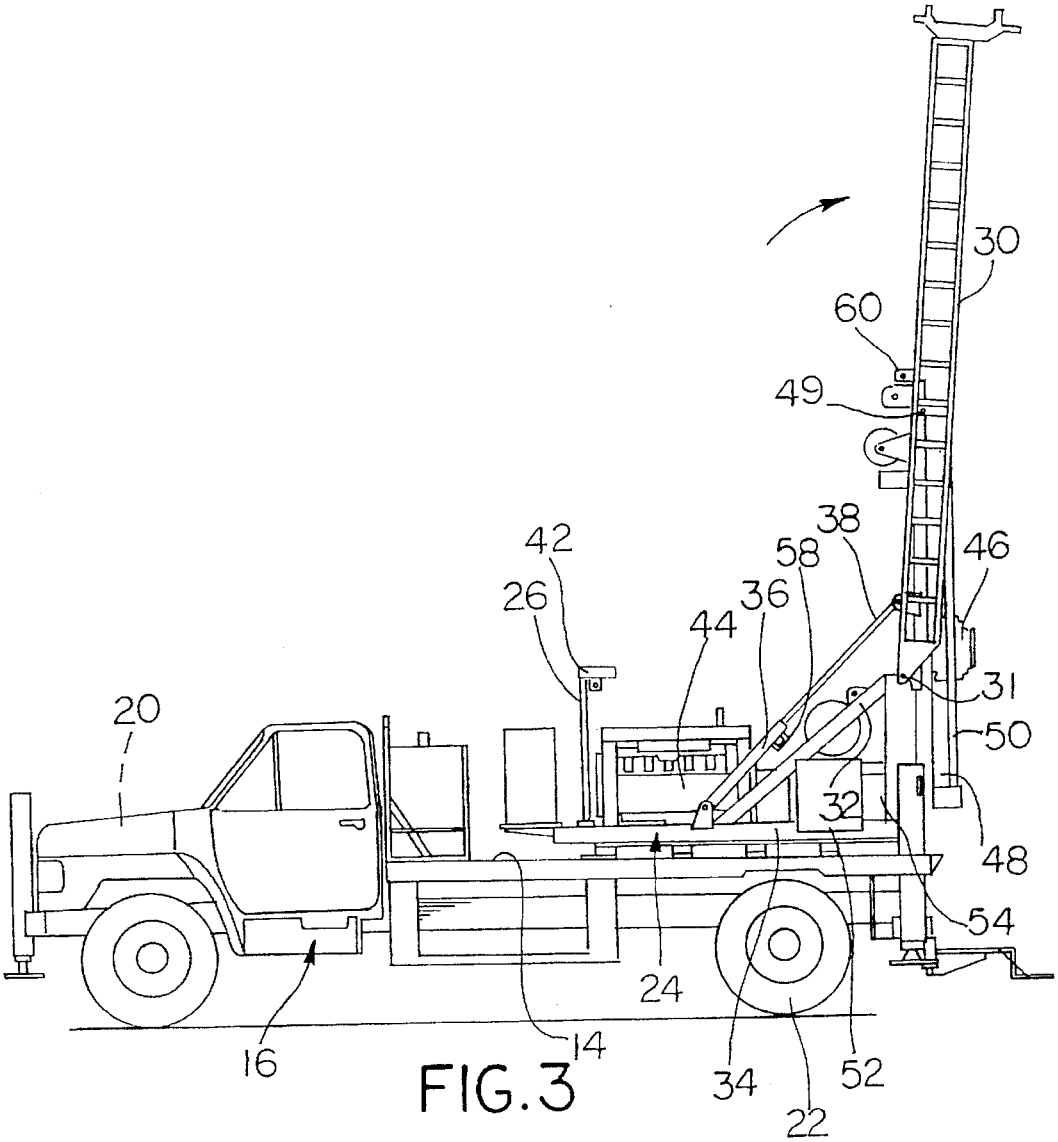
FIG. 3 is a view similar to FIGS. 1 and 2, but illustrating the mast in the erected position.

A double pole, two position switch 56 is mounted on the upright support 28 and is tripped by the feed frame 48 when the feed frame 48 is moved into the fully erected position illustrated in FIG. 3. Another double pole switch 58 is mounted on one of the hydraulic cylinders 36 and is tripped when the corresponding rod 38 extends from the corresponding cylinder 36 by a predetermined amount. A third double pole switch 60 is mounted on the feed frame 48 and is tripped when the switch 60 engages the gusset 42 when feed frame is moved to the fully lowered position illustrated in FIG. 1.

Figure 4:
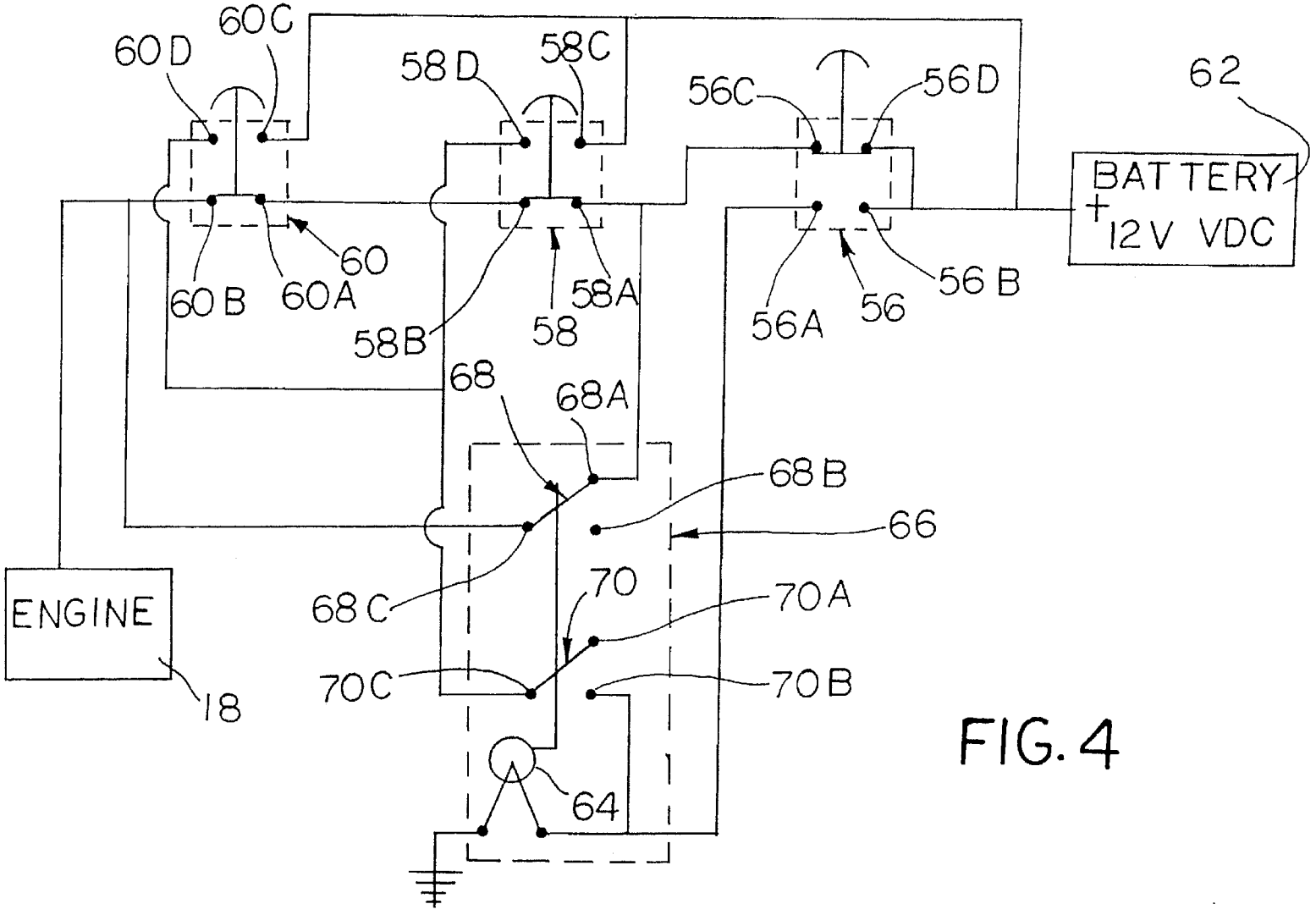
FIG. 4 is a schematic illustration of an electrical circuit incorporating switches pursuant to the safety interlock of the present invention used on the drill rig of FIGS. 1–3.

Referring now to FIG. 4, the poles 56*a*, 56*b* of the switch 56 are connected between vehicle battery 62 and coil 64 of a latching relay 66. Poles 56*c*, 56*d* of the switch 56 are connected between the battery 62 and the pole 58*a* of switch 58. Pole 58*b* of switch 58 is connected to pole 60*a* of switch 60. Pole 60*b* of switch 60 is connected to, for example, the ignition system of the vehicle engine 18, or some other carrier disabling accessory, such as the carrier parking brakes.

Pole 56*d* of switch 56 is connected to battery 62, and pole 56*c* is connected to pole 58*a* of switch 58 and also to pole 68*a* of switch 68 of relay 66, which is operated by energization of the coil 64. Pole 68*c* of switch 68 is connected to the ignition system of engine 18. When switch 68 is operated, the switch arm is moved between the position illustrated connecting poles 68*a* with pole 68*c*, to connect to the actuated position connecting the switch arm with pole 68*b*.

Pole 58*c* of switch 58 is connected to the battery 62, and pole 58*d* of switch 58 is connected to pole 70*c* of relay latching switch 70, which is actuated by the coil 64 from the position illustrated connecting pole 70*c* with dead pole 70*a* to a position connecting pole 70*c* to pole 70*b*, which is connected to the relay coil 64. The pole 60*c* of switch 60 is connected to the battery 62, the pole 60*d* of the switch 60 is connected to pole 70*c* of latching switch 70 within the relay 66.

Figure 2:
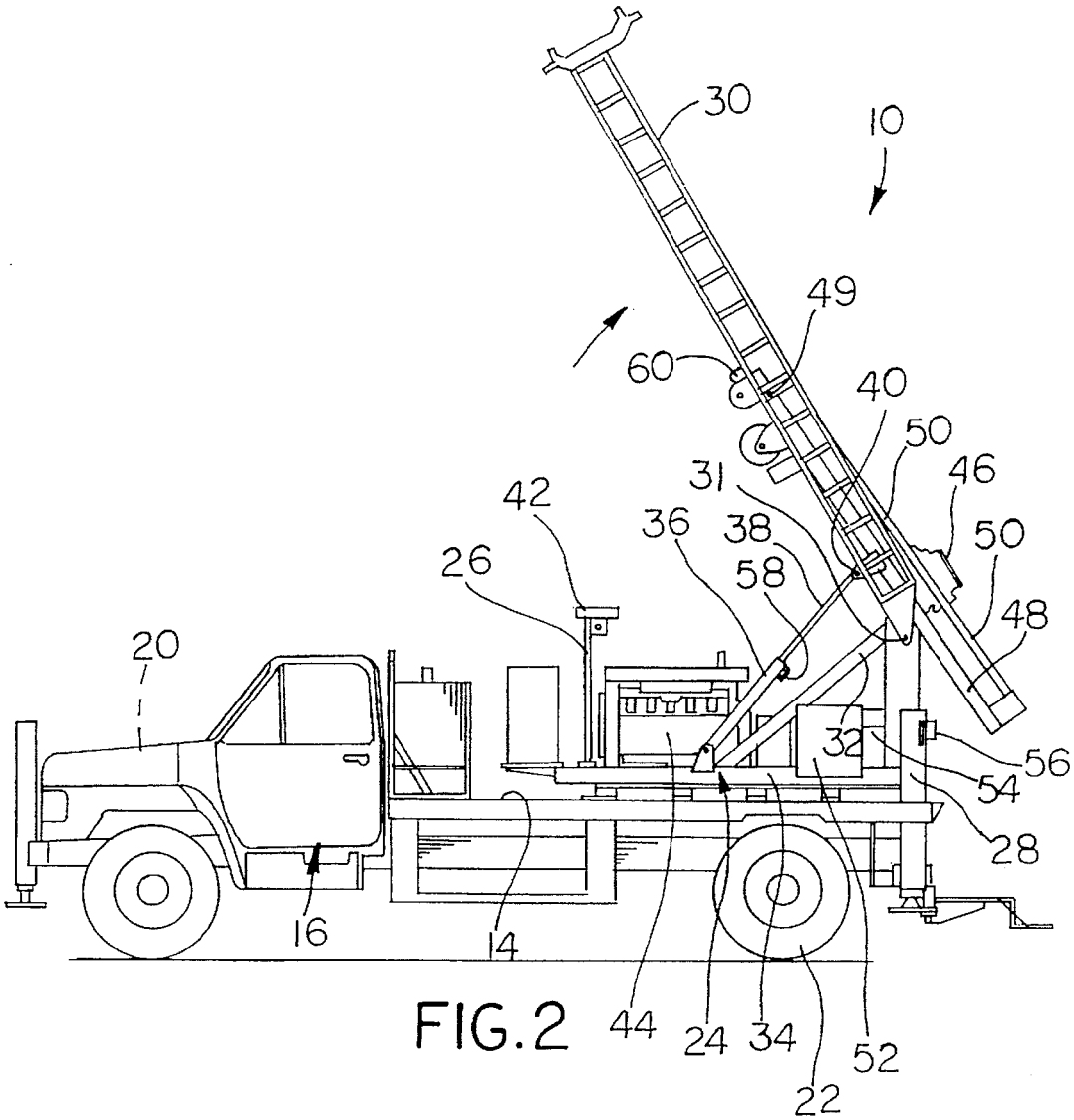
FIG. 2 is a view similar to FIG. 1 but illustrating the mast in an intermediate position between the fully lowered position and the erected position.

The switches 56, 58 and 60 are illustrated in FIG. 4 in the positions they assume when the feed frame 48 is in the fully lowered position as illustrated in FIG. 1. In this condition, a circuit is completed between battery 62 and the ignition system of engine 18 through terminals 56*c*, 56*d* of switch 56 and through the switch 68 of relay 66, and also through terminals 58*a*, 58*b* of switch 58 and terminals 60*a*, 60*b* of switch 60. When the feed frame 48 is raised away from the lowered position, switch 60 is tripped, thereby breaking the connection between terminals 60*a* and 60*b* and initiating a connection between terminals 60*c* and 60*d* to connect the battery 62 to the terminal 70*c* of latching switch 70. However, since the coil 64 is not actuated, the relay does not trip and switch 70 remains open and switch 68 remains closed, thereby providing an electrical path between the battery 62 and the ignition of engine 18. As the feed frame 48 is raised past the intermediate position illustrated in FIG. 2, switch 58 is tripped thereby breaking the connection between the poles 58*a* and 58*b* and initiating a connection between poles 58*c* and 58*d*. Again, the engine 18 continues to be enabled to permit movement of truck 16, since a connection between the battery 62 and the ignition system 18 exists through switch 56 and switch 68. However, when the feed frame 48 is raised to the fully erected position illustrated in FIG. 3, switch 56 is tripped, thereby breaking the connection between the battery 62 and the engine 18, to thereby disable the engine and prevent movement of the carrier or truck 16. At the same time, a connection is initiated between poles 56*a* and 56*b*, thereby supplying power to the relay coil 64 to trip the relay. When this occurs, the latching switch 70 is closed, so that power to the coil 64 is also fed through the switches 58 (through terminals 58*c* and 58*d*) and switch 60 (through terminals 60*c* and 60*d*) and at the same time, the switch 68 is opened. The relay 66 remains in the tripped condition as long as power is fed to the coil 64. It will be noted that, until switch 56 was tripped, operation of the engine 18 was permitted, thereby permitting movement of the carrier or truck 16 as the feed frame 48 is being raise& However, once the feed frame 48 was raised to the fully upright or erected condition thereby tripping switch 56, power to the ignition system of carrier engine 18 is interrupted, thereby disabling the engine and preventing movement of the truck 16.

When the feed frame 48 is lowered, switch 56 is returned to the position illustrated in FIG. 4 as soon as feed frame 48 is moved away from the fully erect position illustrated in FIG. 3. However, the engine 18 remains disabled, because power continues to be fed to the coil 64 through latching switch 70 even though the terminals 56*a*, 56*b* of switch 56 are open. As the feed frame 48 moves through the FIG. 2 position, the switch 58 is returned to the condition illustrated in FIG. 4. Again, however, the engine 18 remains disabled, because the switch 68 has been tripped and switch 60 is also tripped, so that no electrical path is provided between battery 62 and the engine 18. However, when the feed frame is lowered to the fully lowered position illustrated in FIG. 1, the switch 60 is returned to the position illustrated in FIG. 4. Accordingly, the connection between pole 60*c* and 60*d* is broken, thereby interrupting power to the coil 64 (it being remembered that the connection between terminals 56*a* and 56*b* has already been broken), thereby releasing the relay 66 such that the switches 68 and 70 are returned to the positions illustrated. When this occurs, a connection is provided between the battery 62 and the engine 18 through the switches 58, 60 and 68, thereby again enabling the engine of the carrier or truck 16.

Accordingly, the carrier may be moved as the feed frame is erected to permit the carrier to move the feed frame around obstacles, but once the feed frame is erected to the fully erect position illustrated in FIG. 3, the engine 18 of the carrier or truck 16 is disabled, so that the carrier or truck 16 cannot move the drill unit 12 until the feed frame 48 has been lowered into the fully lowered position illustrated in FIG. 1 in which the feed frame 48 rests on a gusset plate 42. It will also be noted that the system illustrated in FIG. 4 cannot easily be defeated. If, for example, only the switch 60 were provided to sense whether the feed frame is either up or down, the system could be relatively easily defeated by merely taping down the feed frame sensing switch. Since the switches 56, 58 and 60 must be actuated in proper order before the engine 18 may be operated, the drill rig operator cannot easily override the safety interlock system provided by the switches 56, 58 and 60 and relay 66.

Figure 5:
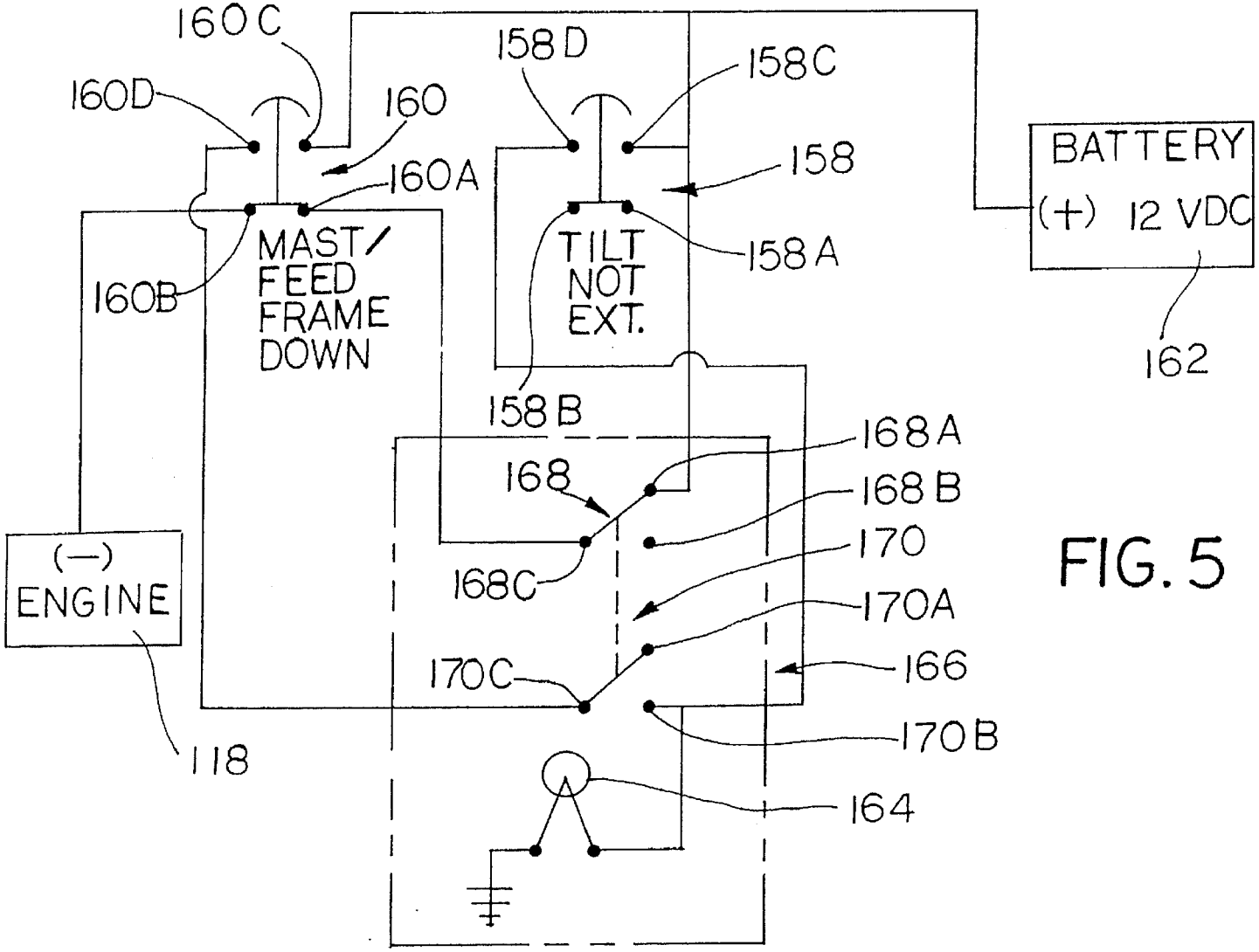
FIG. 5 is a schematic illustration similar to FIG. 4 but illustrating another embodiment of the invention.

Referring now to the alternate embodiment of FIG. 5, elements the same or substantially the same as those in the embodiment of FIGS. 1–4 retain the same reference character, but increased by 100. The circuit illustrated is a carrier mast safety interlock circuit similar to that shown in FIG. 4, but designed for an angle drilling rig. These drilling rigs are designed to bore both at an angle and vertically. Accordingly, when angle drilling, the mast and feed frame are never raised to a truly vertical position, but instead are raised to an angled position between the lowered position and a vertical position to effect angled drilling. Nevertheless, the operator of such angled drilling rigs may be tempted to drive to various boring sites with the feed frame and mast in a nearly vertical position. The interlock circuit illustrated in FIG. 5 prevents movement of such angled drilling rigs after the mast and/or feed frame have been raised to a predetermined angle until the mast and/or feed frame is lowered.

As shown in FIG. 5, a switch 160 is moved to the position illustrated when the feed frame of the angle drilling rig is lowered into a fully lowered position and is actuated to the other position in which contact is made between the terminals 160*c* and 160*d* when the feed frame is raised from the fully lowered position. The switch 158 is mounted on the hydraulic cylinder 36 as is the switch 58 (FIG. 1) and is in the position illustrated when the mast and/or feed frame are fully lowered and is moved to the actuated position in which contact is made between the terminals 158*c* and 158*d* when the hydraulic cylinders are extended to raise the feed frame to a predetermined angle. Accordingly, FIG. 5 illustrates the positions of the switches 158 and 160 when the feed frame is in the fully lowered position. In this condition, a circuit is completed between the battery 162 and the ignition system of the engine 118 through the switch 168 and relay 166 and the terminals 160*a*, 160*b* of the switch 160. Instead of disabling the engine by disabling the ignition system 118, the circuit of FIG. 5 can also be used to disable the carrier in any other matter, such as by control of the carrier parking brakes. When the feed frame is raised from the fully lowered position, the switch 160 is moved from the position illustrated to a position in which contact is made between the terminals 160*c* and 160*d*. Accordingly, the circuit between the battery and the engine is broken, and a circuit is completed between the battery 162 and the terminal 170*c* of the switch 170 of relay 166.

After the mast and/or feed frame is raised to the predetermined angle, switch 158 is tripped thereby making contact between terminals 158*c* and 158*d* thereby completing a circuit between the battery 162 and both the terminal 170*b* of switch 170 and the relay coil 164. Accordingly, the relay coil 164 is energized, thereby tripping the switch 168 to thereby break contact between terminals 168*a* and 168*c* and also tripping switch 170 to make contact between the terminals 170*b* and 170*c*. This completes a circuit through the switch 170 from the battery 162, through the terminals 160*c*, 160*d* of switch 160, so that the coil 164 remains energized even if the switch 158 is moved back to the position illustrated in FIG. 5. Accordingly, the switch 168 will remain in the tripped position, thereby breaking contact between terminals 168*a* and 168*c* even if the switch 160 is moved back to the position illustrated. Accordingly, the operation cannot move the drilling rig, unless the mast is lowered to trip both switches 158 and 160 into the position illustrated in FIG. 5. When this is done, current to the coil 164 is interrupted, thereby returning the relay 166 to the position illustrated.

I claim:

1. Drill rig comprising a carrier having a carrier engine for moving the carrier, a support frame mounted on said carrier, a drilling support mechanism mounted on said support frame and movable between an operative position for effecting a drilling operation and a lowered position for transport by said carrier, a drilling spindle rotatable relative to said drilling support mechanism, a power means for effecting rotation of said drilling spindle, and safety interlock means for disabling said carrier after the drilling support mechanism has been moved to said operative position until the drilling support mechanism is returned to the lowered position.

2. Drill rig as claimed in claim 1, wherein said drilling support mechanism is pivotally mounted on said support frame, said support frame including a support member engaging said drilling support mechanism when the drilling support mechanism is in the lowered position, said safety interlock means including first switch means actuated to a first position when the drilling support mechanism is engaged with the support member and to a second position when the drilling support mechanism is pivoted away from said support member toward said operative position.

3. Drill rig as claimed in claim 2, wherein said safety interlock means further includes second switch means, said second switch means being actuated from a first position to a second position when the drilling support mechanism moves into the operative position and from the second to the first position when the drilling support mechanism moves away from the operative position.

4. Drill rig as claimed in claim 3, wherein said safety interlock means further includes third switch means actuated from a first position to a second position as said drilling support mechanism moves through an intermediate position as the drilling support mechanism is raised from the lowered position to the operative position and from said second position to said first position as said drilling support mechanism is moved back through said intermediate position as said drilling support mechanism is lowered from said operative position back through said intermediate position.

5. Drill rig as claimed in claim 4, wherein said support includes hydraulic cylinders for raising and lowering said drilling support mechanism, said third switch means being actuated after said hydraulic cylinders are extended for a predetermined distance.

6. Drill rig as claimed in claim 4, wherein said safety interlock means includes control means responsive to each of the switch means to prevent enablement of said carrier engine after disablement of the latter in response to raising of the drilling support mechanism to said operative position until the drilling support mechanism is lowered into said lowered position and said first switch is actuated to said first position.

7. Drill rig as claimed in claim 6, wherein said control means includes means responsive to each of said switch means to maintain enablement of said carrier while the drilling support mechanism is raised between said lowered and erected positions.

8. Drill rig as claimed in claim 6, wherein said control means includes a relay controlling disablement and enablement of said carrier, said relay including a coil operating said relay, said coil being controlled by said first, second and third switches.

9. Drill rig as claimed in claim 3, wherein said drilling support mechanism in said operative position is at an angle other than vertical.

10. Drill rig as claimed in claim 2, wherein said safety interlock means includes control means maintaining enablement of said carrier as said drilling support mechanism is being raised toward said operative position but disabling said carrier as said drilling support mechanism is lowered from said operative position until said drilling support mechanism is lowered into said lowered position.

11. Drill rig as claimed in claim 10, wherein said safety interlock means includes lowered drilling support mechanism switching means for sensing that said drilling support mechanism is in the lowered position.

12. Drill rig as claimed in claim 10, wherein said safety interlock means includes drilling support mechanism switching means for sensing that said drilling support mechanism is in the operative position.

13. Drilling as claimed in claim 1, wherein said safety interlock means is connected to the ignition system of said carrier engine.

14. Drill rig comprising a carrier, a support frame mounted on said carrier, a drilling support mechanism mounted on said support frame and movable between an operative position for effecting a drilling operation and a lowered position for transport by said carrier, a drilling spindle rotatable relative to said drilling support mechanism, and safety interlock means for disabling said carrier after the support frame has been moved to said operative position until the feed frame is returned to the lowered position but enabling said carrier as said drilling support mechanism is raised into the operative position.

15. Drill rig as claimed in claim 14, wherein said drilling support mechanism is pivotally mounted on said support frame, said support frame including a support member engaging said drilling support mechanism when the drilling support mechanism is in the lowered position, said safety interlock means including first switch means actuated to a first position when the drilling support mechanism is engaged with the support member and to a second position when the drilling support mechanism is pivoted away from said support member toward said operative position.

16. Drill rig as claimed in claim 15, wherein said safety interlock means further includes second switch means, said second switch means being actuated from a first position to a second position when the drilling support mechanism moves into the erected position and from the second to the first position when the drilling support mechanism moves away from the erected position.

17. Drill rig as claimed in claim 16, wherein said safety interlock means further includes third switch means actuated from a first position to a second position as said drilling support mechanism moves through an intermediate position as the drilling support mechanism is raised from the lowered position to the operative position and from said second position to said first position as said drilling support mechanism is moved back through said intermediate position as said drilling support mechanism is lowered from said operative position back through said intermediate position.

18. Drill rig as claimed in claim 17, wherein said safety interlock means includes control means responsive to each of the switch means to prevent enablement of said carrier after disablement of the latter in response to raising of the drilling support mechanism to said operative position until the drilling support mechanism is lowered into said lowered position and said first switch is actuated to said first position.

19. Drill rig as claimed in claim 16, wherein said drilling support mechanism in said erected position is at an angle other than vertical.

* * * * *